US005654743A

United States Patent [19]

Hu et al.

[11] Patent Number: 5,654,743

[45] Date of Patent: Aug. 5, 1997

[54] PICTURE DISPLAY ARRANGEMENT

[75] Inventors: Shih-Hsien Hu; Shih-Che Yu; Cheng-I (Jack) Shy, all of Taipei, Taiwan; Martin E. Maloney, Hamburg, Germany

[73] Assignee: U.S. Philips Corporation, New York, N.Y.

[21] Appl. No.: 667,285

[22] Filed: Jun. 20, 1996

Related U.S. Application Data

[63] Continuation of Ser. No. 314,559, Sep. 28, 1994, abandoned

[30] Foreign Application Priority Data

Sep. 28, 1993 [BE] Belgium ..... 09301013

[51] Int. Cl.[6] ..... G09G 5/00

[52] U.S. Cl. ..... 345/213; 345/112; 348/473

[58] Field of Search ..... 345/213, 214, 345/212, 10, 12, 13, 14, 112; 348/180, 184, 185, 189, 473, 476

[56] References Cited

U.S. PATENT DOCUMENTS 4,991,023 2/1991 Nicols ..... 345/213

5,031,118 7/1991 Morizot ..... 345/213

5,185,603 2/1993 Medin ..... 345/213

5,400,086 3/1995 Sano et al. ..... 348/678

FOREIGN PATENT DOCUMENTS 4305026 8/1993 Germany .

OTHER PUBLICATIONS

"Ubertragung Eines Zweiten Tonkanals Beim Fernsehen", Rundfunktechnische Mitteilungen, vol. 11, No. 2, 1967, Norderstedt De pp. 108–113 by S. Dinsel.

*Primary Examiner*—Dennis Chow

*Attorney, Agent, or Firm*—Edward W. Goodman

[57] ABSTRACT

In a picture display arrangement, for example, a personal computer and a monitor coupled thereto, the PC generates control signals for adjusting monitor settings (brightness, contrast, picture position, picture dimensions). The control signals are transmitted to the monitor by modulating the synchronizing signal (preferably by pulse-width modulation). The monitor includes a demodulator for deriving the control signals. This enables manual controls on the monitor to be dispensed with. For this, the interface between PC and monitor is not modified. Pulse-width modulation of the synchronizing signals is possible by means of a utility program loaded into the PC.

7 Claims, 4 Drawing Sheets

PICTURE DISPLAY ARRANGEMENT

This is a continuation of application Ser. No. 08/314,559, filed Sep. 28, 1994, now abandoned.

BACKGROUND OF THE INVENTION

1. Field of the Invention

The invention relates to a picture display arrangement comprising a picture source for generating a video signal and a synchronizing signal, and a monitor for displaying a picture represented by said signals, said monitor having an adjustment circuit for adjusting picture parameters in response to control signals applied to the circuit. The invention also relates to said picture source and said monitor separately.

2. Description of the Related Art

A known arrangement of the type defined in the opening paragraph is formed, for example, by a personal computer and a picture monitor coupled thereto. The personal computer has a video card, which generates the video signal and the synchronizing signal. The synchronizing signal is representative of the line frequency and the picture frequency of the video signal.

In general, a monitor requires adjustment of picture parameters such as horizontal and vertical picture position, horizontal and vertical picture amplitude, brightness and contrast. Initially, this adjustment is necessary to adapt the monitor to the picture source. Subsequent adjustments may also be required, for example, to correct changes as a result of ageing. In prior-art monitors, adjustment is effected by means of manual controls, e.g., a potentiometer for each parameter. These potentiometers are often concealed by a cover, or they can only be adjusted by means of a screwdriver. There are also modern monitors which comprise a microprocessor with a built-in On Screen Display (OSD) generator and an adjustment program. The OSD generator then displays a menu on the display screen and a parameter can be selected and subsequently adjusted under control of the adjustment program. Said mechanical and electronic adjustment facilities constitute a substantial part of the cost price of the monitor and impose restrictions on the freedom of design of the monitor.

SUMMARY OF THE INVENTION

It is an object of the invention to provide an arrangement which mitigates the above problems.

To this end the arrangement in accordance with the invention is characterized in that the picture source is adapted to generate the control signals and modulate the synchronizing signal with the control signals, the monitor having a demodulator for demodulating the synchronizing signal in order to obtain the control signals. This enables expensive and less aesthetic provisions of the monitor, such as control knobs and an OSD generator, to be dispensed with. The control signals are now generated by the picture source and can be transmitted from this source to the monitor via an already existing connection. The arrangement is particularly attractive if the picture source is formed by a personal computer because, by means of suitable software, such a computer can be adapted to perform a menu-controlled adjustment program for the monitor.

In an embodiment of the picture source, the pulse width of synchronizing pulses is modulated. When PC video cards are used, this embodiment is particularly interesting because the width of the synchronizing pulses is generally dictated by a register value which is easy to change under software control. The frequency of the synchronizing pulses then remains invariably representative of the line frequency or picture frequency of the video signal. In practice, the synchronizing signal thus formed is found not to disturb the synchronization of the monitor. It can be applied to the customary synchronizing circuit without any farther processing and, as a consequence, it is fully compatible with a non-modulated synchronizing signal. Therefore, the picture source can readily be coupled to a prior-art monitor with autonomous adjustment provisions. Preferably, the vertical synchronizing pulses are modulated. Demodulation is possible with a simple and relatively slow microprocessor. Moreover, the vertical picture synchronization of a monitor has a minimal susceptibility to modulation of the vertical pulse width.

A preferred embodiment of the picture source is characterized in that the control signal is transmitted in the form of a bit series preceded by a start bit, the logic value of a bit being represented by the pulse width of a synchronizing pulse. In order to enable a plurality of picture parameters to be adjusted, each bit series may include a code for a picture parameter and a desired value for this parameter. Instead of an absolute parameter value, the bit series may include an instruction to increment or decrement the current parameter value by a given amount.

The monitor in accordance with the invention has a demodulator for demodulating the synchronizing signal in order to obtain the control signals. The demodulator demodulates the pulse width of the synchronizing pulses and determines the corresponding logic bit value. After detection of a start bit, the demodulator derives the control signal from the bit series following the start bit.

DESCRIPTION OF THE PREFERRED EMBODIMENT

Figure 1:
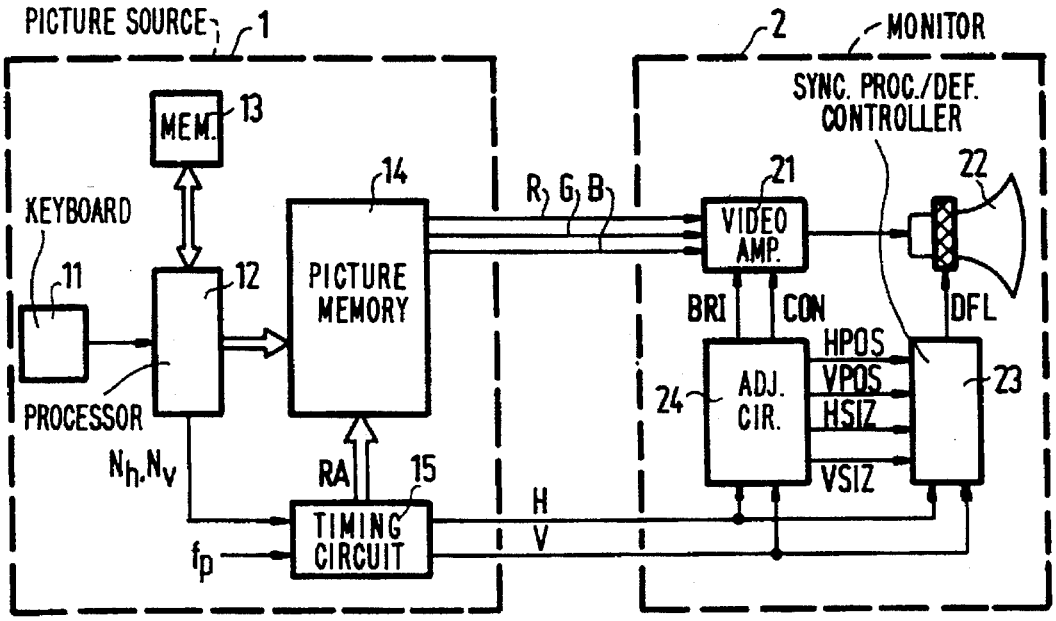
FIG. 1 shows diagrammatically a picture display arrangement in accordance with the invention.

FIG. 1 shows diagrammatically a picture display arrangement in accordance with the invention. The arrangement comprises a picture source 1 and a monitor 2. The picture source supplies a video signal consisting of the three primary color signals R, G and B, a horizontal synchronizing signal H and a vertical synchronizing signal V to the monitor.

In the present embodiment, the picture source 1 is formed by a personal computer. This computer comprises a keyboard 11, a processor 12, a working memory 13, a picture memory 14 and a timing circuit 15. In practice, the picture memory 14 and the timing circuit 15 are accommodated on a plug-in card, which is commercially available as a "video card". Pictures are generated in that the processor 2 loads the RGB values of the individual pixels into the picture memory 14. The picture memory 14 has a capacity of a multitude of pixels and is read out periodically with a given line and picture frequency under the control of the timing circuit 15. For this purpose, the timing circuit supplies consecutive read addresses RA to the picture memory. In synchronism therewith, the circuit generates the synchronizing signals H and V to be supplied to the monitor 2.

Figure 2:
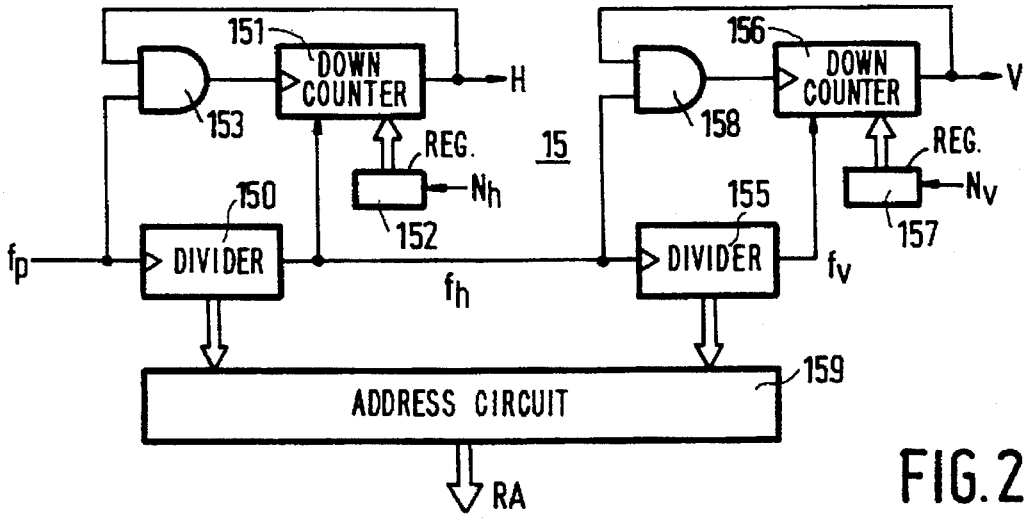
FIG. 2 shows an example of a timing circuit shown in FIG. 1.
Figure 3:
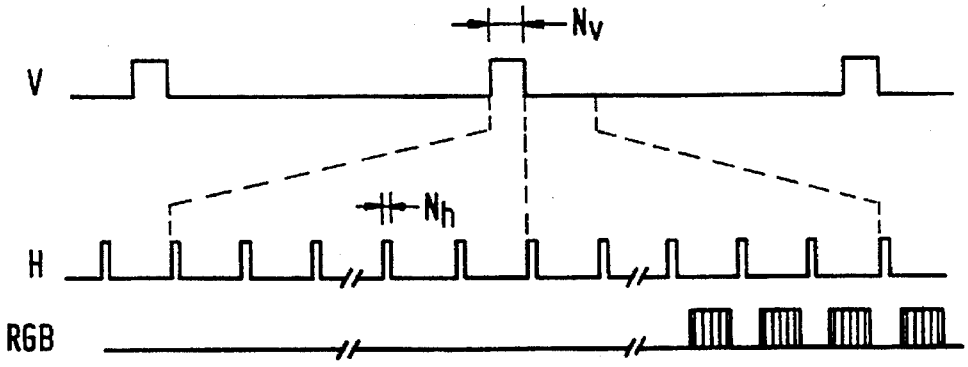
FIG. 3 shows some time diagrams to illustrate the operation of the timing circuit shown in FIG. 2.

FIG. 2 shows an example of the timing circuit 15. The timing circuit comprises a first divider 150 which reduces the frequency of a clock signal having the pixel frequency $f_p$ to a line frequency $f_h$, and a second divider 155 which reduces the fine frequency $f_h$ to the picture frequency $f_v$. The output signal of the first divider 150 also constitutes a load signal for a down-counter 151, so that every line, this counter is loaded with a value $N_h$ stored in a register 152. As long as the down-counter has a non-zero count, it will receive clock pulses of the pixel frequency via an AND gate 153. When the count has become zero, the AND gate blocks subsequent clock pulses. This yields the synchronizing signal H having the line frequency $f_h$ and a pulse width of $N_h$ pixels. This signal is denoted by the reference H in FIG. 3.

Likewise, the output signal of the second divider 155 constitutes a load signal for a further down-counter 156, so that every picture, this counter is loaded with a value $N_v$ stored in a further register 157. As long as the down-counter has a non-zero count, it will receive clock pulses of the fine frequency via a further AND gate 158. When the count has become zero, the further AND gate blocks subsequent clock pulses. This yields the synchronizing signal V having the picture frequency $f_v$ and a pulse width of $N_v$ lines. This signal is denoted by the reference V in FIG. 3. The addressing circuit 159 derives the read addresses RA for the picture memory from the counts produced by the first divider 150 and the second divider 155. The video signal read from the picture memory by means of these read addresses is denoted by the reference RGB in FIG. 3.

It appears from the foregoing that the pulse width $N_h$ of the horizontal synchronizing signal and the pulse width $N_v$ of the vertical synchronizing signal are determined by the contents of the registers 152 and 157, respectively. Both registers receive the respective value from the processor 12 (see FIG. 1). In the example described below, it will be assumed that the pulse width $N_h$ does not change. However, the pulse width $N_v$ will be modulated by the processor 12 in a manner to be described hereinafter.

Figure 4:
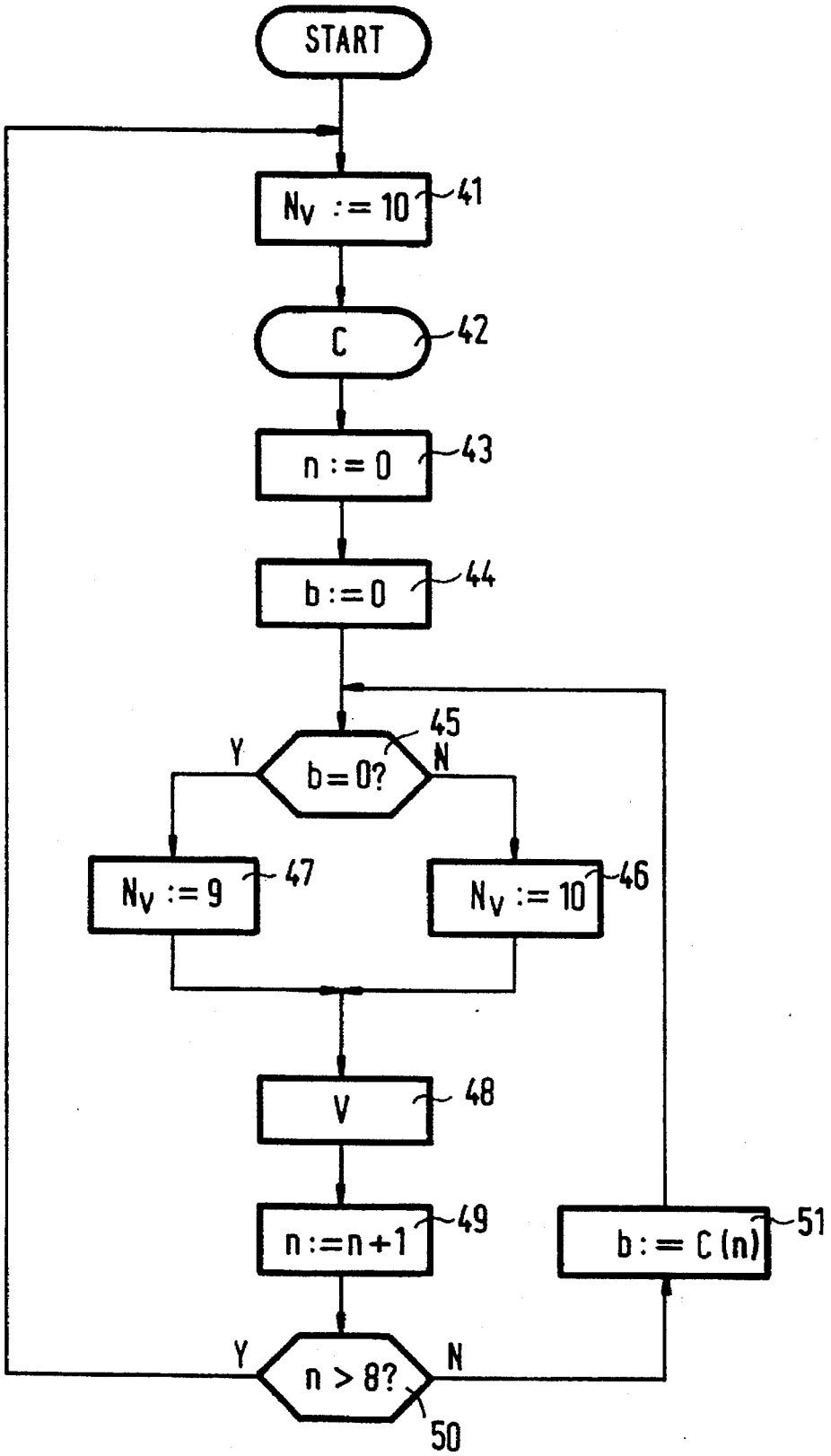
FIG. 4 shows a flowchart of an adjustment program carried out by a processor shown in FIG. 1.

The working memory 13 of the personal computer 1 (see FIG. 1) can be loaded with an adjustment program for adjusting the monitor 2. FIG. 4 shows the flow chart of an example of this adjustment program. In a step 41, the value $N_v$=10 is applied to the register 157 (see FIG. 2). This is a default value for the pulse width of the vertical synchronizing pulses. Subsequently, a menu program 42 is carried out. Broadly speaking, this menu program comprises the following steps: generating a picture in which picture parameters, such as horizontal picture position, vertical picture position, horizontal picture amplitude, vertical picture amplitude, brightness and contrast, appear as menu options; selecting a picture parameter by means of cursor keys or a mouse; and assigning a value to the selected picture parameter or activating an instruction to increment or decrement the actual value.

It will be assumed hereinafter that a given code has been assigned to each picture parameter, for example, the code 1 for the horizontal picture position, 2 for the vertical picture position, 3 for the horizontal picture amplitude, 4 for the vertical picture amplitude, 5 for the brightness, and 6 for the contrast. Furthermore, the instruction to increment or decrement the parameter value is represented by a bit having the value 0 for "incrementing" and the value 1 for "decrementing". Thus, the menu program 42 supplies a control signal in the form of, for example, an 8-bit code word C. By way of example, the control signal "reduce contrast" is represented by the code word C=10000110 (hex 86).

Subsequently, the code word C is transferred to the monitor. In a step 43 of the adjustment program, the initial value 0 is assigned to a bit counter n, and in a step 44, a bit b to be transmitted (initially a start bit) is given the logic value 0. In a step 45, the value of the bit b to be transmitted is determined. For b=1, the normal value $N_v$=10 (step 46) is applied to the register 157 (see FIG. 2). For b=0, a deviating value, for example, $N_v$=9 (step 47), is applied. In a step 48, the adjustment program then waits until the corresponding vertical synchronizing pulse has been produced. Since the value of the start bit is 0, the width of this pulse becomes $N_v$=9. Subsequently, the bit counter n is incremented by 1 in a step 49 so that it assumes the value 1. In a step 50, it is checked whether n has exceeded the value 8. For the time being, this is not the case so that in a step 51, the value of the first bit C(1) of the code word C is assigned to the next bit to be transmitted. The program now repeats the steps 45–48 in which the pulse width is set to the value 9 or 10, depending on the value of the bit b. After all 8 bits of the code word C have thus been processed, the program returns, via the step 50, to the step 41 in which again the default value $N_v$10 is assigned to the pulse width. Subsequently, the selected parameter may be further incremented or decremented in the subprogram 42, or another parameter may be selected.

Figure 5:
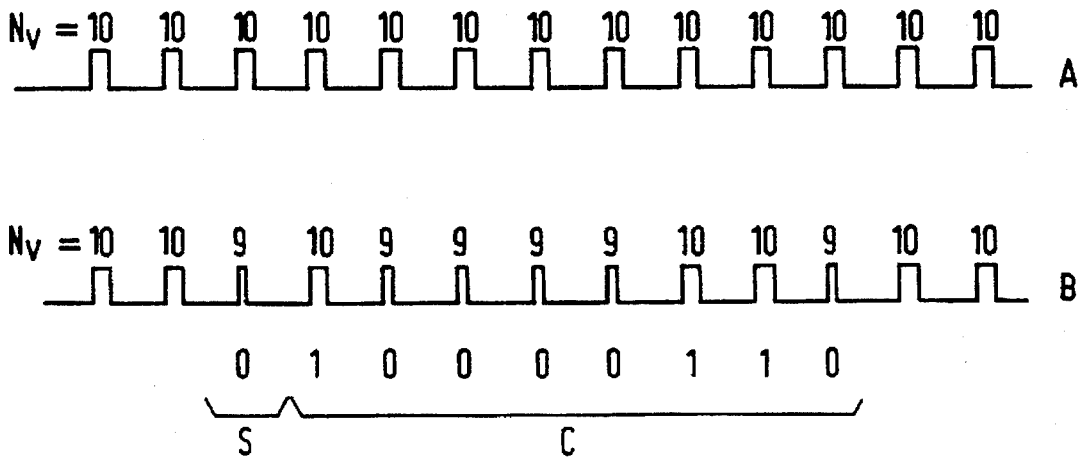
FIG. 5 shows some time diagrams to explain the flowchart shown in FIG. 4.

In FIG. 5 (not to scale), waveform B shows a train of vertical synchronizing pulses whose pulse width has thus been modulated by means of the start bit S and the code word C=10000110 ("reduce contrast"). By way of reference, waveform A shows the synchronizing signal generated in the absence of a control signal.

The operation of the monitor 2 will now be explained with reference to FIG. 1. The monitor comprises a video amplifier 21 which receives the video signals RGB and applies them to a picture tube 22. The amplifier has two inputs to which analog control voltages BRI and CON, for adjusting the brightness and the contrast, respectively, are applied. The monitor further comprises a sync processor and deflection controller 23 which receives the synchronizing signals H and V from the picture source and supplies corresponding deflection signals DFL to the picture tube 22. The circuit 23 has four inputs to which analog control voltages HPOS, VPOS, HSIZ and VSIZ are applied for adjustment of the horizontal picture position, the vertical picture position, the horizontal picture amplitude and the vertical picture amplitude, respectively. So far, the monitor is of generally known construction. The video amplifier 21 is formed by, for example, the integrated circuit TDA4881, which is commercially available from Pips. The sync processor and deflection controller 23 is formed by, for example, the integrated circuit TDA4852, which is also commercially available from Philips.

Figure 6:
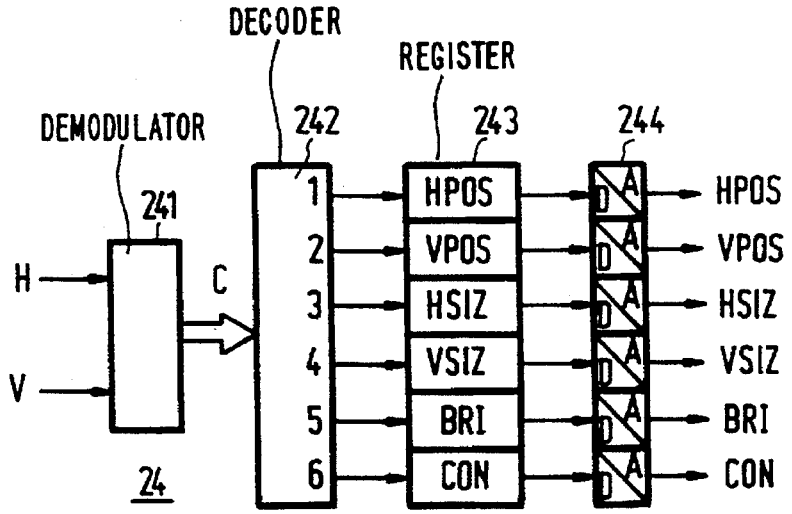
FIG. 6 shows an example of an adjustment circuit shown in FIG. 1.

The monitor further comprises an adjustment circuit 24 which receives the synchronizing signals H and V and demodulates and decodes said analog control voltages from these synchronizing signals. This adjustment circuit is shown in more detail in FIG. 6. It composes a demodulator 241, a decoder 242, a plurality of non-volatile registers 243 and a plurality of digital-to-analog converters 244. Although the demodulator and the decoder may be constructed as dedicated hardware circuitry, their respective function can also be implemented by means of a microprocessor. An example is the microprocessor PCE84C886 from Philips.

Figure 7:
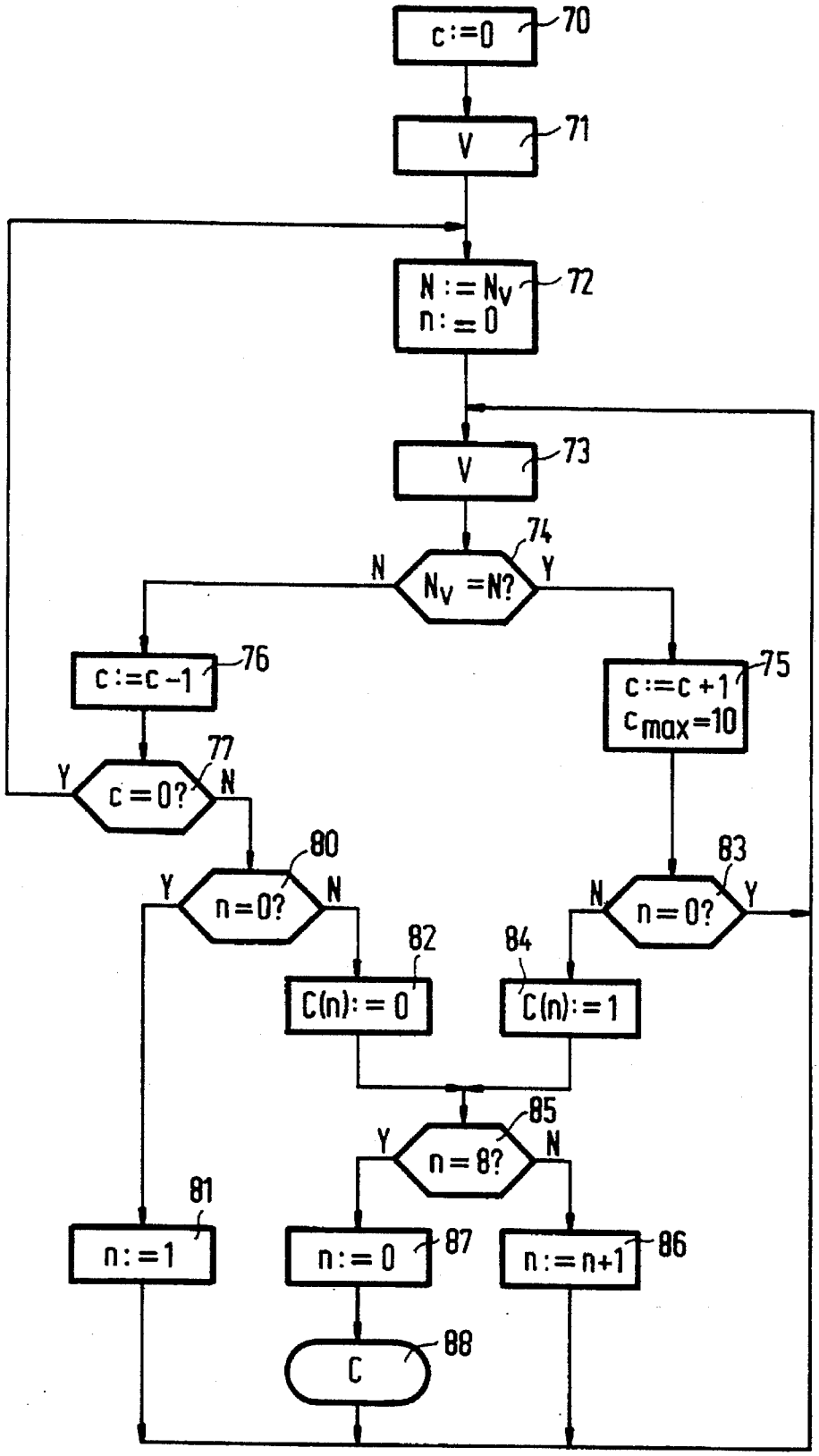
FIG. 7 shows a flowchart to illustrate the operation of the adjustment circuit shown in FIG. 6.

The operation of the adjustment circuit 24 is controlled by a control program performed by said microprocessor. FIG. 7 shows the flowchart of an example of this control program. The program includes a measurement part (steps 70–77), in which the unmodulated pulse width of the vertical synchronizing pulses is measured. This part is not needed if a standard value has been adopted for the unmodulated pulse width, for example the above-mentioned value $N_v$=10. The program further comprises a demodulation part (steps 80–88), in which the synchronizing signal is demodulated in order to obtain the control signal.

In a program step 70, which is performed when the monitor is switched on, the initial value 0 is assigned to a pulse counter c. Subsequently, in a step 71, the first vertical synchronizing pulse is awaited and its width $N_v$ is determined. This is effected by counting the number of line pulses H that occur during one picture pulse V. In a step 72, the width $N_v$ is stored in a variable N and the initial value 0 is assigned to a bit counter n. The value n=0 of the bit counter indicates that no start bit of a control signal has been detected yet. In a step 73, a following synchronizing pulse is awaited. In a step 74, it is ascertained whether the pulse width $N_v$ of this pulse is equal to the stored value N. If this is the case, the pulse counter c is incremented by 1 in a step 75, c having a predetermined maximum count, for example 10. After the demodulation steps 83–88 (to be described hereinafter) have been carded out, the program returns to the step 73 to wait for the next synchronizing pulse. If and as long as the synchronizing signal has not been modulated, all the synchronizing pulses will have the same pulse width N and the pulse counter will reach and retain its maximum count.

If a deviating pulse width has been detected in the step 74, the pulse counter is decremented by 1 in a step 76. If this deviating value recurs, for example 10 times in succession, c will reach the value 0. Now there is apparently no question of modulation of the pulse width but of a default pulse width which differs from N. This is detected in a step 77, after which the program returns to the step 72 in which the new pulse width N is stored. In this way, the control program measures the unmodulated pulse width, so that this pulse width need not be laid down in a standard.

The demodulation steps of the control program will now be described. If the deviating pulse width occurs, a step 80 is performed to check whether the bit counter n is still 0. This means that now a start bit has been received. The value 1 is then assigned to n in a step 81. From now on, the bit counter n indicates which bit of the code word C is being received. If again a deviating pulse width occurs in this situation, the value 0 will be assigned to the bit C(n) of the code word C in a step 82. If the normal pulse width occurs upon receipt of the start bit (step 83), the value 1 will be assigned to C(n) in a step 84. After this, a step 85 is performed to ascertain whether all 8 bits of the code word have been received. As long as this is not the case, the bit counter n is incremented by 1 (step 86). When all 8 bits have been received, the code word is complete. The bit counter n then resumes the value 0 (step 87) to prepare for the next reception of a start bit.

Finally, in a subprogram 88, the code word C is decoded and the monitor is adjusted, accordingly. For example, if the code word C=10000110 ("reduce contrast") has been received, the actual value of the corresponding register 243 (CON in FIG. 6) is decremented by 1. After digital-analog conversion 244, this results in a smaller control voltage CON for the video amplifier 21 (see FIG. 1) and a corresponding reduction of the picture contrast.

It is noted that where in the foregoing control signals were mentioned, these need not be restricted to signals for adjusting the horizontal and vertical picture position, horizontal and vertical picture amplitude, brightness and contrast. It is equally possible to control other monitor functions as well, for example switching between a plurality of line and picture frequencies, audio volume and stereo balance, (de)activation of a screen saver, switching the monitor on or off, and the like. The invention is also applicable to carrying out factory adjustments such as black level settings, $V_{g2}$ adjustment, etc.

We claim:

1. A picture source for generating a video signal and a synchronizing signal to be applied to a monitor, said synchronizing signal comprising horizontal synchronizing pulses whose frequency is representative of a line frequency, and vertical synchronizing pulses having a pulse frequency representative of a picture frequency of the video signal, characterized in that the picture source comprises:

means for generating control signals for at least adjusting picture parameters of the monitor, each of said control signals being in the form of an N-bit series, N being an integer, preceded by a start bit; and means for modulating the synchronizing signal with said control signals, said modulating means modulating pulse widths of a serial number N of the pulses of one of the horizontal synchronizing pulses and the vertical synchronizing pulses, each of said pulse-width modulated pulses corresponding to a logic value of a respective bit in the N-bit series forming each control signal, whereby said series of N pulse-width modulated pulses carries the control signal.

2. A picture source as claimed in claim 1, in which the means for modulating modulates pulse width of the vertical synchronizing pulses.

3. A picture source as claimed in claim 1, characterized in that each bit series includes a code for a picture parameter and a value for said parameter.

4. A picture source as claimed in claim 1, characterized in that each bit series includes a code for a picture parameter and an instruction for changing the value of said parameter by a given amount.

5. A monitor for displaying video pictures in response to a received video signal and a received synchronizing signal, said received synchronizing signal comprising synchronizing pulses, said monitor having an adjustment circuit for adjusting picture parameters in response to control signals applied to the circuit, each of said control signals being in the form of an N-bit series, N being an integer, preceded by a start bit, characterized in that the pulse widths of a serial number N+1 of the pulses of synchronizing signal are modulated with the logic values of the start bit and the corresponding bits in the N-bit series forming the control signal, and the monitor further comprises a demodulator for demodulating the serial number N+1 of pulse-width modulated pulses in the synchronizing signal to obtain the start bit and each of the corresponding bits of the N-bit series in each of the control signals, said demodulator having an output coupled to the adjustment circuit for applying the control signals to the adjustment circuit.

6. A monitor as claimed in claim 5, further comprising a decoder for deciding the bit series into a picture parameter and a value for said parameter.

7. A monitor as claimed in claim 5, further comprising a decoder for decoding the bit series into a picture parameter and an instruction for changing the value of said parameter by a predetermined amount.

* * * * *